US005511825A

United States Patent [19]

Van De Pol

[11] Patent Number: 5,511,825

[45] Date of Patent: Apr. 30, 1996

[54] STATIONERY

[76] Inventor: Rudolf E. Van De Pol, 45a Twelfth Ave. Parktown North, Johannesburg, South Africa

[21] Appl. No.: 280,519

[22] Filed: Jul. 26, 1994

[30] Foreign Application Priority Data

Jul. 26, 1993 [ZA] South Africa ..... 93/5367
Jun. 7, 1994 [ZA] South Africa ..... 94/3965

[51] Int. Cl.[6] ..... B42F 13/00

[52] U.S. Cl. ..... 281/36; 281/21.1; 281/29; 402/73

[58] Field of Search ..... 402/74–78, 26, 402/73; 281/21.1, 22, 27.1, 27.2, 29, 35–37

[56] References Cited

U.S. PATENT DOCUMENTS

| | | | |
|---|---|---|---|
| 1,051,527 | 1/1913 | Thompson | 402/75 X |
| 1,109,260 | 9/1914 | Stanley . | |
| 1,414,758 | 5/1922 | Stavenhagen | 402/80 L |
| 4,355,821 | 10/1982 | Crawford . | |
| 4,744,689 | 5/1988 | Sternberg . | |
| 4,848,948 | 7/1989 | Pitts . | |
| 4,997,207 | 3/1991 | Feldman . | |
| 5,209, 593 | 5/1993 | Ros | 402/73 X |
| 5,222,825 | 6/1993 | Wyant . | |
| 5,267,804 | 12/1993 | Baumgarten . | |

FOREIGN PATENT DOCUMENTS

| | | | |
|---|---|---|---|
| 655231 | 12/1937 | Germany | 281/36 |
| 1536551 | 1/1970 | Germany | 402/75 |
| 431453 | 8/1967 | Switzerland | 281/37 |
| 1057457 | 2/1967 | United Kingdom | 402/75 |
| 93/24335 | 12/1993 | WIPO | 402/26 |

*Primary Examiner*—Frances Han
*Attorney, Agent, or Firm*—Browdy and Neimark

[57] ABSTRACT

A file comprises a rectangular cover having a front wing, a rear wing, and a spine between the wings. A lever arch mechanism is secured to the rear wing close to the spine to receive and retain thereon punched paper sheets. The side edges of the spine are inclined to the lower edge of the spine at a small angle. The file is extremely stable when standing on its lower edges. Another file has the cover in the form of a parallelogram with the side edges of the wings and spine parallel and inclined at a small angle to the top and bottom edges. A third file has its wings of rectangular shape with the lower edge of the spine inclined relative to the side edges of the spine.

9 Claims, 3 Drawing Sheets

STATIONERY

BACKGROUND TO THE INVENTION

The invention is concerned with an article of stationery known as a "letter file", that is a file comprising a cover having a front wing, a rear wing and a spine between the wings, all having side edges and upper and lower edges with the side edges of the spine being connected to, or forming part of, the inner side edges of the wings; the file further comprising a mechanism mounted on a base plate which is attached to the rear wing close to the spine and being arranged to receive and retain thereon punched paper sheets.

The term "mechanism" as used herein is intended to mean a device which comprises (i) two part members each in the form of an arch and optionally, a lever for moving the parts apart, to enable the paper sheets to be placed thereon, (a file with such a mechanism is normally called a "lever arch file") or (ii) one or more ring members having two parts sprung towards each other which are movable relatively by hand or spring operated opening device, or triggers, to permit the paper sheets to be threaded thereon (for convenience herein the term "arch" will be used for both the arches and the ring members—except where otherwise clear from the context), (a file with such a mechanism is normally called a "ring file") or (iii) posts on to which the paper sheets may be carried. The term "inclined" as used herein is intended to mean at an angle other than 180° or 90°.

The spine and the wings are often formed from a single sheet of cardboard, having score lines provided, about which the cardboard can fold, to separate the spine from the wings.

Lever arch files and ring files with mechanisms mounted on the rear wing are, and have for many years been, extensively used in commerce for filing and storage of documentation. They are stored vertically, resting on the lower edges of the wings and spine. Such lever arch files and ring files suffer from an important disadvantage, viz when a lever arch file or ring file carries a significant amount of paper, it tends to collapse towards the front wing. This means that the lever arch files are not free standing but have to be supported. The support can be provided by stacking the lever arch files to fill shelves having end walls or by providing rigid, normally cardboard, box-like dust covers into which the files are individually received. In addition an attempt has been made to render the lever arch files rigid by providing slots in the front wing through which the arches can pass to lock the front wing against such movement as will permit collapse of the lever arch file.

Furthermore in U.S. Pat. No. 4,997,207 an elongated member is provided to connect together the free side edges of the wings to form a rigid structure. In U.S. Pat. No. 5,267,804 there is shown a file or binder which is not a lever arch file as defined above in which rigid corner pieces are provided on one wing to butt against the other wing thereby to make the binder self-supporting. U.S. Pat. No. 4,744,689 shows a lever arch file having a closure connected by a hinge to the rear wing of the cover to provide rigidity. The known methods of preventing collapse of lever arch files have, at best, been only partially successful, being expensive and/or inflexible in use.

SUMMARY OF THE INVENTION

According to one aspect of the invention there is provided a lever arch file wherein the lower edge of the spine is inclined relative to the side edges of the spine so that the angle between the lower edge of the spine and side edge between the spine and the front wing is an acute angle. The side edges of the spine are preferably parallel.

The aforesaid acute angle is conveniently very slightly less than 90° and may be between 85° and 89° and is preferably about 88½°. The top and bottom edges of the cover conveniently lie on parallel straight lines. The side edges of the wings are preferably at right angles thereto so that the side edges of the spine are inclined relative to the side edges of the wings. In another arrangement, the side edges of the wings are parallel to the side edges of the spine and inclined to the top and bottom edges of the cover. In yet a further arrangement, all the side edges are parallel and at right angles to the top and bottom edges of the wings with the bottom edge of the spine inclined to the aforesaid bottom edges so that the lower edge of the front wing is at a small angle and the lower edge of the rear wing is located higher than the lower edge of the front wing. The lower edge of the rear wing may be normal to the side edges of the spine and about one to two millimeters higher than the lower edge of the front wing which is similarly normal to the side edges of the spine.

The wings and the spine are preferably formed on a single sheet of cardboard being separated one from the another by score lines along the spine edges, and preferably the cover is made from material whereof the grain direction is parallel or substantially parallel to the upper and lower edges of the cover; in other words the score lines extend across the grain direction.

The size of the spine may be reduced also, typically to the same height as the height of the mechanism.

Four embodiments of the invention will now be described by way of example with reference to the accompanying drawings in which certain dimensions and in particular certain angles are shown exaggerated in the interest of clarity.

SHORT DESCRIPTION OF DRAWINGS

FIG. 1 is a view of a lever arch file of the invention in the open position, FIG. 2 is a front view of the lever arch file in its normal storage position, FIG. 3 is a plan view of the lever arch file in the closed position, FIGS. 4, 5 and 6 are views similar to FIG. 1 (but in the case of FIGS. 5 and 6 omitting the mechanism) of a three modified lever arch files of the invention, and, FIG. 7 is a plan showing how the files can be stacked for storage and transport.

DESCRIPTION OF PREFERRED EMBODIMENT

Figure 1:
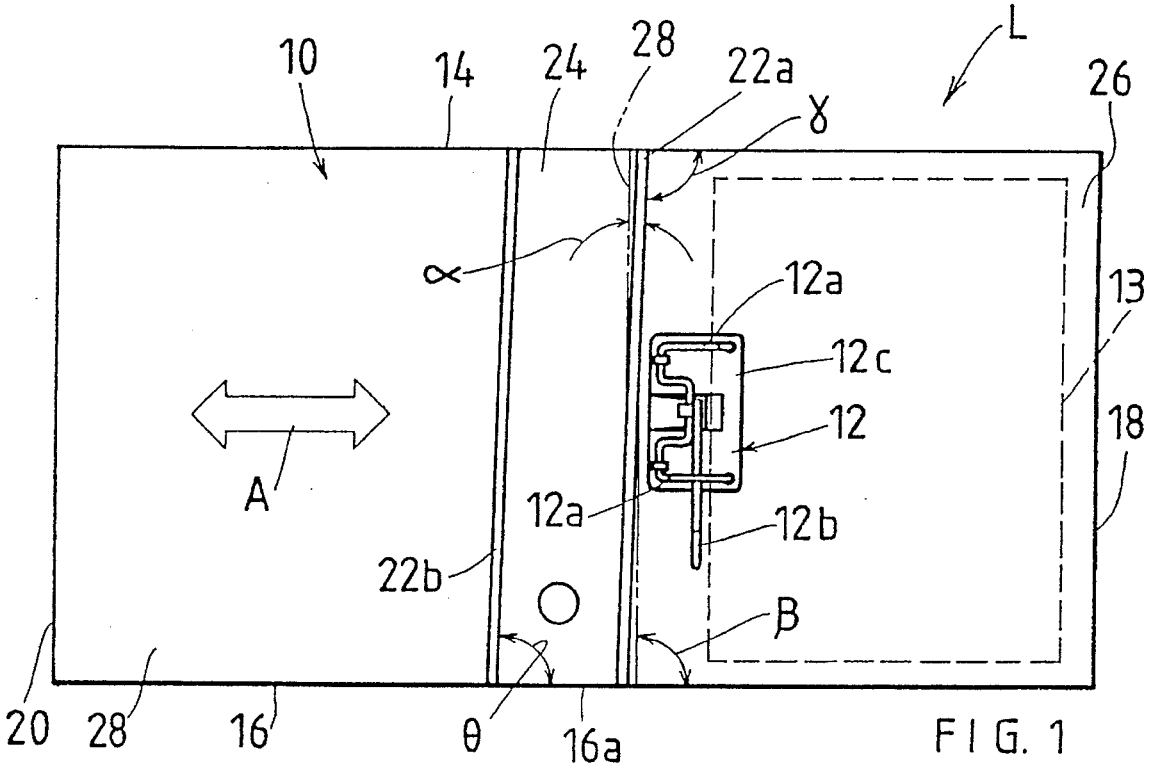
Figure 2:
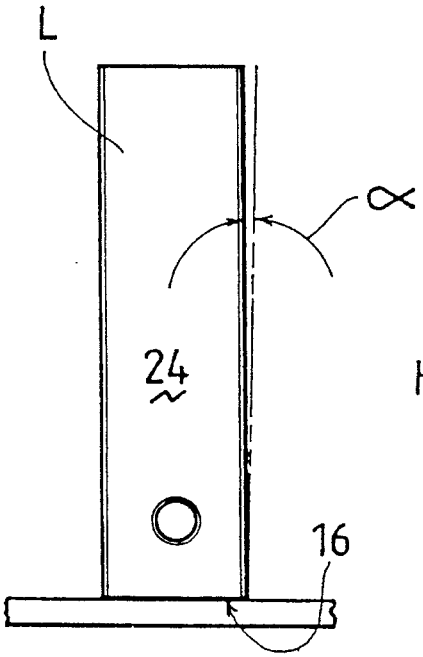
Figure 3:
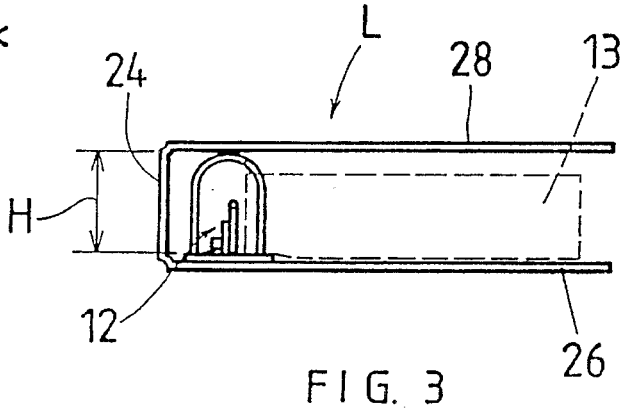

Referring now to FIGS. 1, 2 and 3, a lever arch file L comprises a cover 10 with a the lever arch mechanism 12. The mechanism 12 is conventional and comprises a pair of arches **12*a* which are movable against spring bias by a lever 12*b* and which are carried by a base plate 12*c* secured to the cover. A stack of paper sheets 13** is carried by the mechanism in conventional manner.

The cover 10 comprises a single piece of cardboard cut in the shape of a rectangle having transverse and vertical dimensions of 630 mm and 320 mm respectively with upper and lower edges 14 and 16 and side edges 18 and 20. The cardboard is, as is conventional formed by deposition of water borne fibres dried and compressed by rollers so that its grain direction is substantially constant throughout. The cover 10 is cut so that the grain direction of the cardboard, indicated by the double headed arrow A, extends parallel to the longer upper and lower edges 14 and 16 of the cover 10.

Mid-way along the cover 10 are a pair of parallel score lines 22*a* and 22*b* that extend from the upper to the lower edges 14 and 16 of the cover 10 and that are spaced apart by 70 mm to form the side edges of a spine 24. Adjacent the score line 22*a* is formed a rear wing 26 and adjacent the score line 22*b* is formed a front wing 28. The rear wing 26 carries the lever arch mechanism 12 midway along its height.

The score lines 22 are inclined slightly to a line 28 normal to the upper and lower edges 14 and 16. The disposition of the score lines 22 is such that (a) the distance along the upper edge of the rear wing 26 from the free edge 18 to the nearer score line 22*a* is 268 mm and (b) the distance of the other score line 22*b* to the edge 20 of the cover is 282 mm. The dimensions along the lower edge 16 of the cover 10 are the converse.

Thus the rear wing 26 has its lower edge slightly longer than its upper edge. The angle $\alpha$ at which the score lines 22 are inclined to a line 28 normal to the upper and lower edges is 1°15' (one degree fifteen minutes). The angle $\beta$ of the lower inner corner of the rear wing 26 is 88°45' and that $\gamma$ of the upper inner corner is 91°15'. It will noted specifically that the lower edge 16*a* of the spine 24 is inclined relative to the side edges of the spine constituted by the scores 22 so that the angle $\theta$ between the lower edge 16*a* of the spine 24 and side edge 22*b* between the spine and the front wing 28 is an acute angle (i.e. angle $\beta$).

The height H of the arches 12*a* of the lever arch mechanism 12 is 70 mm, i.e. the same as the width of the spine 24. Therefore, because the arches 12*a* are located inwardly of the spine 24 when the file L is in the closed position (as shown in FIG. 3), the front wing 28 will be restrained by the arches 12*a* from moving to a position at which it is less than 90° to the spine 24, i.e. the front and rear wings 18 and 20 will be substantially parallel.

I have found that a lever arch file L made from a cover 10 is very stable and when in the closed position and standing on its lower edge 16 (as shown in FIG. 2) will not tend to topple. This is so even when the lever arch mechanism 12 carries a large amount of paper. Furthermore because the cover 10 is made from a rectangular sheet of cardboard, it can be cut, and if necessary covered using conventional machinery that operates at high speed. The lever arch file L when used and standing on the lower edges will appear to the eye to be identical to a lever arch file having a spine extending at right angles to the upper and lower edges.

The amount of the tilt of the lever arch file L when erected (i.e. the angle of the wings to the line 28*a* normal to the base) will be the same as the angle $\alpha$. Because this angle is so small, the lever arch file L approximates very closely to the appearance of a conventional lever arch file when standing upon its lower edges as shown (the extreme tilt shown in FIG. 2 being for clarity only as mentioned above).

I have found that the bending of the cardboard across the grain tends to have the result that the cover is stiffer and tends to return to the open position. This too assists in maintaining the lever arch file against toppling.

Furthermore, by reducing the width of the spine to the height of the arches, the wings 26 and 28 of the file L will not tend to approach each other to take up a substantially triangular form which would result in instability of the lever arch file. On the contrary the fact that the wings can approach themselves no more than being substantially parallel provides for improved stability.

SECOND EMBODIMENT

Figure 4:
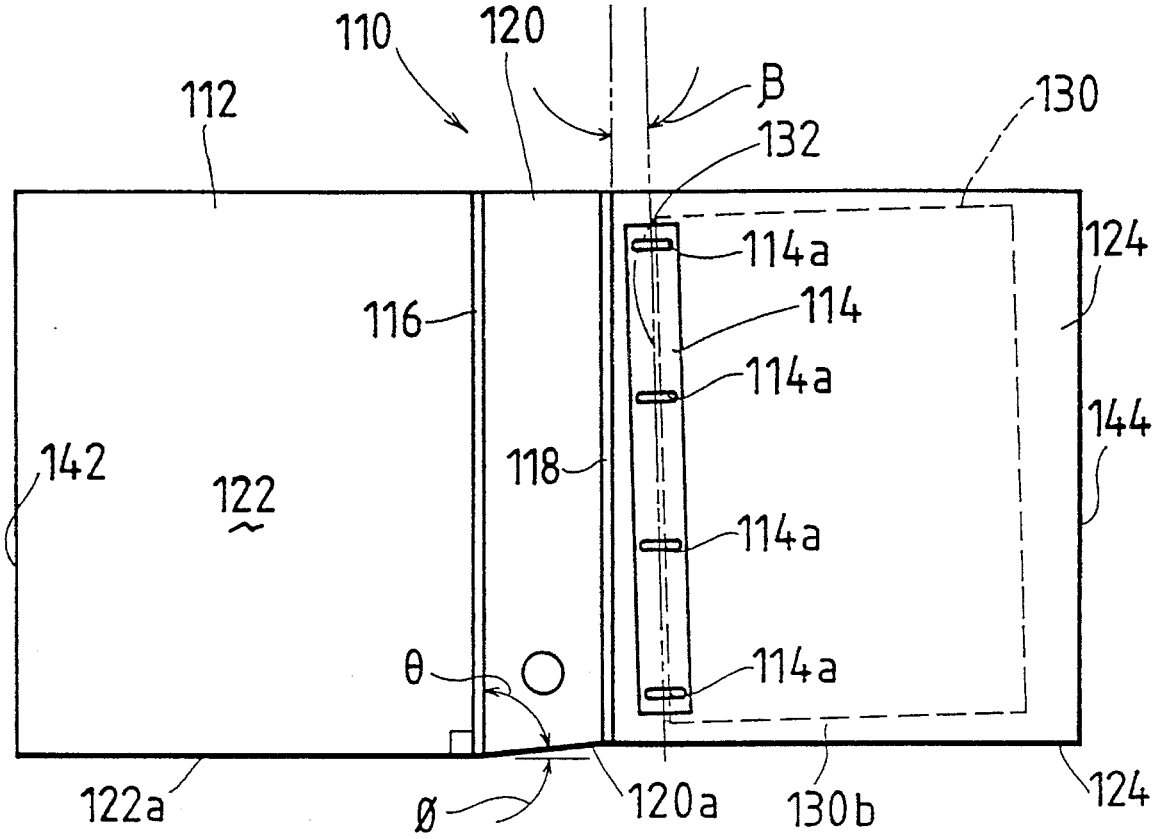

Reference is now made to FIG. 4 showing a file 110 comprising a cardboard cover 112 and a spring mechanism 114 mounted thereon to carry a stack 130 of punched paper sheets. The mechanism 114 is also conventional and comprises four rings 114*a* that have two parts which are sprung towards each other and which are movable away from each other manually or by triggers at the ends.

The cover 112 is made from a single sheet of cardboard divided by a pair of parallel transverse scores 116 and 118 into a central spine 120, a rectangular front wing 122 and a rectangular rear wing 124. The ring mechanism 114 is located so that the lower edges 130*b* of the paper stack 130 being spaced upwardly from the lower edge 124*a* of the rear wing 124.

The spine is 70 mm wide, i.e. about the height of the arches 114*a*, and the wings are 270 mm wide. The height of the front wing 122 is 318 mm. The upper edge 132 of the cover is straight and the free edges 142 and 144 of the wings 122 and 124 are at right angles thereto. As thus far described, the lever arch file 110 is conventional.

The lower edges 122*a* and 124*b* of the wings 122 and 124 are straight and lie normal to the score lines 116 and 118 and the free side edges 142 and 144 of the wings 122 and 124 respectively.

The lower edge 120*a* of the spine 120 is straight and inclined upwardly at an angle of $\phi$ to the continuation of the lower edge 122*a* of the front wing 122 so that the spine 120 is trapezoidal in shape. Consequently the lower edge 120*a* of the spine 120 is inclined relative to the side edges of the spine 120 so that the angle $\theta$ between the lower edge 120*a* of the spine 120 and side edge 116 between the spine 120 and the front wing 122 is an acute angle $\theta$ (i.e. $90°-\phi$).

The lower edge 124*a* of the rear wing 124 extends from the upper end of the edge 120*a*. Thus the rear wing 124 is slightly smaller than the front wing 122. As a consequence when the lever arch file 110 rests on the lower edge 120*a*, 122*a* and 124*a* (as shown in FIG. 2), the lever arch file 110 tilts slightly away from the front wing towards the rear wing.

The line 132 joining the centres of the arches 114*a* of the lever arch mechanism 114 are inclined to the score lines 116 and 118 by an angle $\beta$ of about 2½°. This feature has the effect of raising the outer ends of the paper stack 130 which tends to throw the mass of the paper stack 130 on to the spine 120 which adds to the effect of enabling the file 110 to stand erect freely.

The amount of the tilt of the lever arch file 110 is kept to a minimum so that the lever arch file 110 approximates very closely to the appearance of a conventional lever arch file when standing upon its lower edges (taking substantially the same appearance as the file 10 shown in FIG. 2). To this end, the angle $\phi$ may be one degree or less. Conventiently the difference in the heights of the wings may be one millimetre, which with an 70 mm spine means that the angle $\phi$ is slightly less than forty nine minutes. Thus the tilt will be virtually imperceptible except under close examination. The difference in the heights of the wings should not be too great for two main reasons. First, the file may then tend to collapse when only a small stack of papers is carried thereby and second, the appearance caused by a large tilt may be unacceptable. It is my present view that the difference in the wing heights should not be greater than 5 mm so that the angle $\phi$ and hence the tilt will be not more than 3°35' for an 80 mm spine and 4°15' for a 70 mm spine.

THIRD EMBODIMENT

Figure 5:
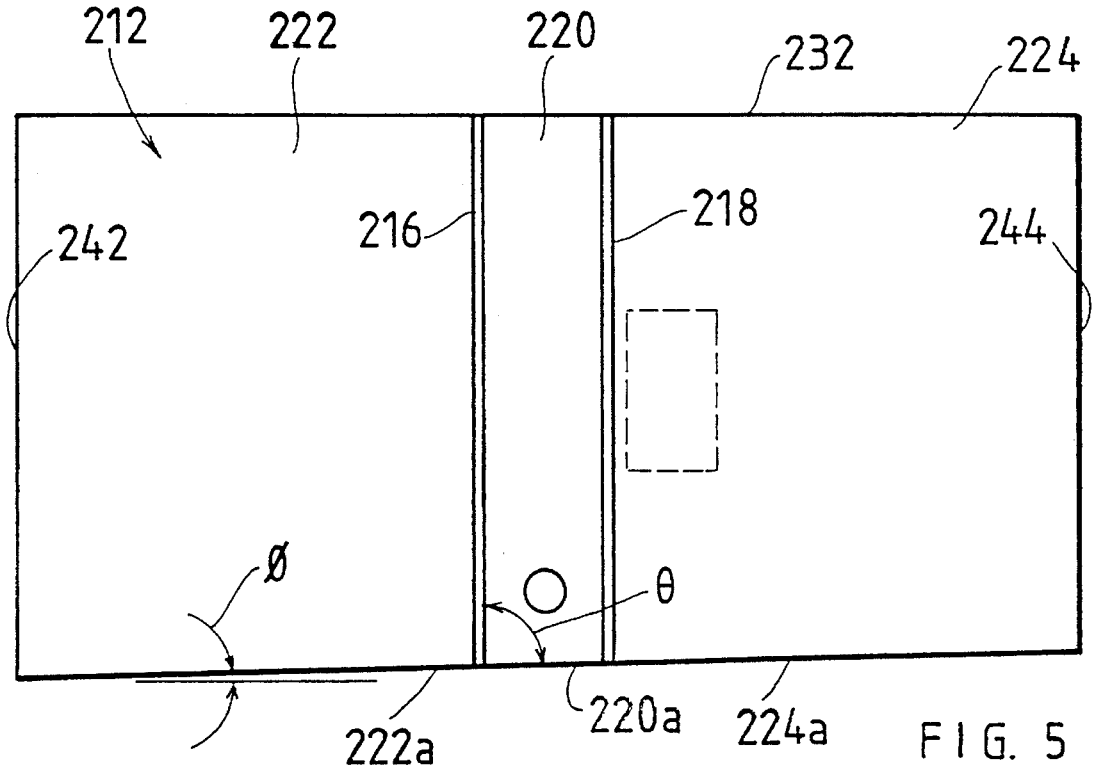

Reference is now made to FIG. 5 (in which items similar to those of FIG. 4 have the same references distinguished by the prefix 200). In this embodiment, the scores 216 and 218 forming inter alia the side edges of the spine 220 are parallel to the side edges 242 and 244 of the wings 222 and 224. The lower edges 222*a*, 220*a* and 224*a* are aligned and inclined to the scores 216 and 218 by an angle $\phi$. The angle $\theta$ between the lower edge 220*a* of the spine 220 and side edge 216 between the spine 220 and the front wing 222 is an acute angle, i.e. 90°-$\phi$. Typically in a lever arch file having a 70 mm spine and wings of 270 mm width, the outer edge 242 of the front wing 222 is 319 mm long and the outer edge 244 of the rear wing 224 is 314 mm long. Thus the angle $\phi$ will be about 4°05'.

By aligning the lower edges 222*a*, 220*a* and 224*a*, the manufacturing process of the cover 212 is simplified.

FOURTH EMBODIMENT

Figure 6:
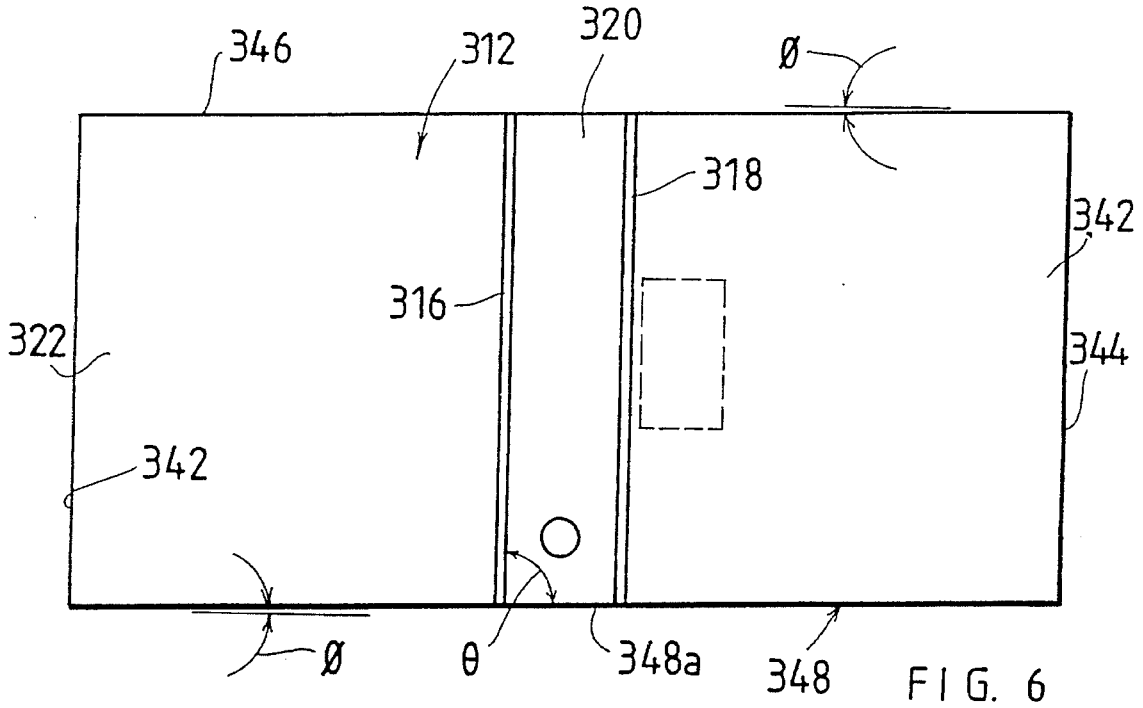

Reference is now made to FIG. 6 (in which items similar to those of FIG. 4 have the same references distinguished by the prefix 300). The cover 312 is similar to that of FIG. 5 with the lower edges of the spine 320 and wings 322 and 324 are aligned and inclined to the scores 316 and 318 (and hence the outer edges 342 and 344 of the wings). In addition the upper edge 346 of the cover is straight and inclined at an angle $\phi$ to a line 328 normal to the scores 316 and 218 so as to be parallel to the lower edge 348. Consequently the lower edge 348*a* of the spine 320 is inclined relative to the side edges 316 and 318 of the spine so that the angle $\theta$ between the lower edge 310*a* of the spine 320 and side edge 316 between the spine and the front wing 322 is an acute angle.

This arrangement simplifies still further the manufacture of the cover 312. Furthermore, the upper corner of the front wing, will, when the lever arch is standing on its lower edges be more closely aligned with the upper corner of the rear wing so that the appearance of the lever arch file 310 when so standing corresponds more closely the appearance of a conventional lever arch file.

Figure 7:
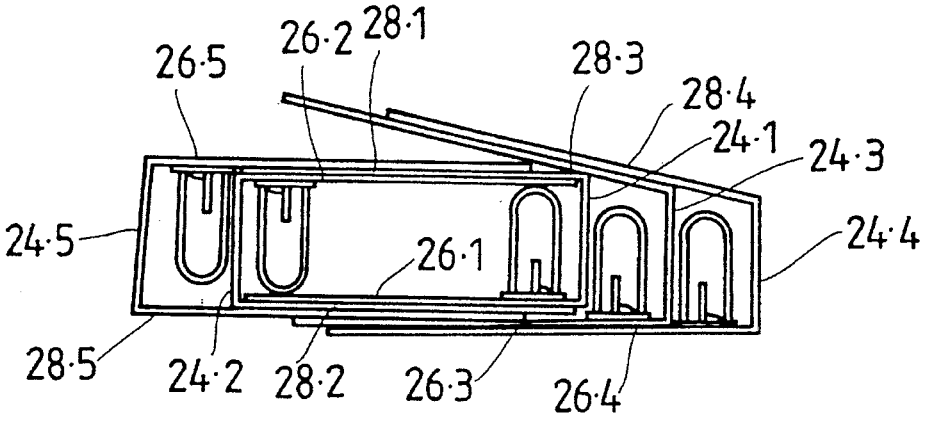

The files can be stacked as shown in FIG. 7 for storage or transport. The spines 24.1, 24.3 and 24.4 of three files face one direction and the spines 24.2 and 24.5 of two other files face the opposite direction. The wings of the files are interleaved as shown in the drawings. The files are arranged close together with the mechanisms closely adjacent or butting against the spines. The stack of files will normally be held together by shrink wrap which will pull in the leaves 28.3, 28.4 and 26.5, which are slightly flexible, so that the exterior of the stack will approach more closely to a rectangle.

The invention is not limited to the precise constructional details hereinbefore described and illustrated in the drawings. Thus for example the various dimensions and angles may also vary save that the angle at which the score lines are inclined to the upper and lower edges are preferably no more than 5°, preferably less than 2° and indeed may be as little as 30' (half a degree). The sizes of the spine and wings may vary as desired. These parts may be made of plastics material or may be plastic coated. The cover may be formed from three separate parts connected in conventional manner. The arch mechanism may be mounted on a carrier plate that is realisably connected to the base plate on the rear wing. The angle at which the line joining the arches are inclined to the scores may vary. The other angles mentioned above may also vary as desired within the constraints apparent from the above description.

I claim:

1. A file comprising a cover having a front wing, a rear wing and a spine between the wings, all having a side edges and upper and lower edges with the side edges of the spine being connected to the inner side edges of the wings; the file further comprising a mechanism secured to the rear wing close to the spine and being arranged to receive and retain thereon punched paper sheets; the lower edge of the spine being inclined relative to the side edges of the spine so that the angle between the lower edge of the spine and side edge between the spine and the front wing is an acute angle.

2. A file as claimed in claim 1 in which the aforesaid acute angle is between 85° and 89°.

3. A file as claimed in claim 2 in which the aforesaid acute angle is about 88½°.

4. A file as claimed in claim 1 in which the top and bottom edges of the cover lie on parallel straight lines and the side edges of the wings are at right angles thereto, and the side edges of the spine are inclined relative to the side edges of the wings.

5. A file as claim in claim 1 in which the top and bottom edges of the cover lie on parallel straight lines and the side edges of the wings are parallel to the side edges of the spine and inclined to the top and bottom edges of the cover.

6. A file as claimed in claim 1 in which all the side edges are parallel and at right angles to the top and bottom edges of the wings, and the bottom edge of the spine is inclined to the top and bottom edges so that the lower edge of the rear wing is located higher than the lower edge of the front wing.

7. A file as claimed in claim 1 in which all the side edges are parallel and at right angles to the top edge of the cover and the bottom edge of the cover is continuous and inclined to the side edges.

8. A file as claimed in claim 1 in which the wings and the spine are formed from a single sheet of cardboard being separted one from the another by score lines along the spine edges, and the cover is made from material whereof the grain direction is parallel to the upper and lower edges of the cover.

9. A file as claimed in claim 1 in which the width of the spine is the same as the height of arches of the mechanism.

* * * * *